US010578350B2

(12) United States Patent
Yao et al.

(10) Patent No.: US 10,578,350 B2
(45) Date of Patent: Mar. 3, 2020

(54) LIFTING SHELF BRACKET AND REFRIGERATOR HAVING SAME

(71) Applicants: HEFEI HUALING CO., LTD., Hefei (CN); HEFEI MIDEA REFRIGERATOR CO., LTD., Hefei (CN); MIDEA GROUP CO., LTD., Foshan (CN)

(72) Inventors: Jun Yao, Hefei (CN); Mingbo Jiang, Hefei (CN)

( * ) Notice: Subject to any disclaimer, the term of this patent is extended or adjusted under 35 U.S.C. 154(b) by 0 days.

(21) Appl. No.: 16/351,544

(22) Filed: Mar. 13, 2019

(65) Prior Publication Data

US 2019/0212054 A1 Jul. 11, 2019

Related U.S. Application Data

(63) Continuation of application No. PCT/CN2016/103805, filed on Oct. 28, 2016.

(51) Int. Cl.
*A47B 96/04* (2006.01)
*F25D 25/02* (2006.01)
(Continued)

(52) U.S. Cl.
CPC ..... *F25D 25/024* (2013.01); *F25D 23/067* (2013.01); *F25D 25/04* (2013.01); *F25D 2325/021* (2013.01)

(58) Field of Classification Search
CPC ..... F25D 23/067; F25D 25/024; F25D 25/04; F25D 2325/021
See application file for complete search history.

(56) References Cited

U.S. PATENT DOCUMENTS 4,757,725 A * 7/1988 Beugin ..... G11B 15/6751 74/422
5,913,584 A * 6/1999 Swindell ..... A47B 57/06 108/108

(Continued)

FOREIGN PATENT DOCUMENTS

CN 1319754 A 10/2001
KR 20100056026 A 5/2010

OTHER PUBLICATIONS

The Office Action dated May 29, 2019 in the corresponding EP application No. 16916639.4

*Primary Examiner* — Matthew W Ing
(74) *Attorney, Agent, or Firm* — Kilpatrick Townsend & Stockton, LLP

(57) ABSTRACT

A lifting shelf bracket and a refrigerator having same are provided. The shelf bracket includes: a first rack and a second rack arranged vertically and parallel to each other, and toothed surfaces of the first rack and the second rack are opposite to each other; a first gear and a second gear meshing with each other and disposed between the first rack and the second rack, the first gear meshing with the first rack, and the second gear meshing with the second rack; a movable fixing plate, the second gear being rotatably connected to the movable fixing plate (5) via a first rotation shaft; a first transmission rod having an end passing through the fixing plate and fixedly connected to the first gear, and the first transmission rod rotatable around a central axis thereof; and a locking device disposed to the fixing plate for locking and unlocking the first transmission rod.

12 Claims, 8 Drawing Sheets

(51) Int. Cl.
*F25D 23/06* (2006.01)
*F25D 25/04* (2006.01)

(56) References Cited

U.S. PATENT DOCUMENTS

| | | | | |
|---|---|---|---|---|
| 7,536,927 | B2 * | 5/2009 | Fleytman | E05F 11/423 49/349 |
| 8,226,184 | B2 * | 7/2012 | Kang | A47B 57/06 108/108 |
| 2010/0060124 | A1 * | 3/2010 | Kang | F25D 25/02 312/408 |
| 2010/0176704 | A1 * | 7/2010 | Kim | F25D 25/024 312/408 |
| 2014/0354132 | A1 * | 12/2014 | Jessie | F25D 25/025 312/334.8 |

* cited by examiner

LIFTING SHELF BRACKET AND REFRIGERATOR HAVING SAME

CROSS-REFERENCE TO RELATED APPLICATION

This application is a continuation of International Application No. PCT/CN2016/103805, filed on Oct. 28, 2016, which claims priority to and benefits of Chinese Patent Application Serial No. 201610839623.7, filed with China National Intellectual Property Administration on Sep. 21, 2016, the entire content of which is incorporated herein by reference.

FIELD

The present disclosure relates to the field of home appliance, and in particular, to a lifting shelf bracket and a refrigerator having the same.

BACKGROUND

In the related art, most refrigerators have a shelf configured as a single rectangular flat glass shelf or a flat plastic shelf, and the glass shelf is placed on ribs in a liner or is engaged with the ribs in the liner to be fixed via a fitted structure of the glass shelf itself and the liner. Since the shelves are fixedly placed in the upper, middle and lower positions in the cabinet, the height and position of the shelf may not be adjusted at will. For the refrigerator having a large (high and deep) volume, it is very inconvenient to place food on the uppermost shelf and to take food off the uppermost shelf.

There are a few brands of refrigerators in the market that have introduced the lifting shelf bracket to meet a user's needs for storing food and other articles at different heights. For example, in a patent whose number is 201510149798.0 and whose title is "shelf assembly and refrigerator", a groove is provided in a side wall of the refrigerator, and a plurality of rotary knobs are provided in the groove to support the shelf. However, this design may not adapt to any height as needed, and the height to be adjusted can only be a distance between two rotary knobs. Similarly, in a patent whose number is 201120239738.5 and whose title is "refrigerator and device for raising and lowering shelves thereof", a plurality of recesses that match support blocks on both sides of the shelf are provided in the refrigerator, and the shelf is fixed via engaging the support block in the recess. This design also has the disadvantage of not being able to adapt to any height as needed. Moreover, when adjusting the height of the shelf, it is necessary to manually hold the shelf, which is inconvenient for operation. For another instance, in a lifting shelf described in patent CN01112021.5, the shelf can be moved up and down as a whole by adjustment. This shelf has an advantage that the height of the shelf can be effectively adjusted, so as to save space for placing the lower objects, and hence the function of the shelf can be effectively utilized. However, this structure also has an insufficient lifting height, and when the shelf is provided with a heavy object thereon, there may be the risk of screw tripping.

SUMMARY

Embodiments of the present disclosure are to provide a lifting shelf bracket whose height can be adjusted as needed. Thus, the height of the movable shelf bracket can be effectively adjusted with great convenience and stability.

Another embodiment of the present disclosure is to provide a refrigerator having the above raised/lowering shelf bracket.

The lifting shelf bracket according to one of embodiment of the present disclosure includes: a first rack arranged vertically having a toothed surface; a second rack arranged parallel to the first rack, and having a toothed surface opposite to the toothed surface of the first rack. In one embodiment, toothed surface may be a surface of the tooth on a gear or used for gear transmission. Further, a first gear and a second gear meshing with each other, the first gear and the second gear being disposed between the first rack and the second rack, the first gear meshing with the first rack, and the second gear meshing with the second rack; a fixing plate disposed at a same side of the first rack and the second rack in a width direction of the first rack and the second rack, the fixing plate being movable in a length direction of the first rack and the second rack, and the second gear being rotatably connected to the fixing plate via a first rotation shaft; a first transmission rod having a central axis and an end passing through the fixing plate and fixedly connected to the first gear, and the first transmission rod being rotatable around the central axis; and a locking device disposed to the fixing plate for locking and unlocking the first transmission rod.

In the lifting shelf bracket according to the embodiments of the present disclosure, when the first transmission rod is rotated, the axial rotation of the first transmission rod drives the first gear to rotate, thereby driving the second gear that meshes with the first gear to rotate, so that the first gear and the second gear can be moved up and down along the length direction of the first rack and the second rack, then the first transmission rod is locked by the locking device, and hence the height of the raised/lowering shelf bracket is positioned. Thus, the height of the movable shelf bracket can be effectively adjusted as needed, and is also easy to adjust. Further, the gear connection is adopted to provide great stability.

According to an embodiment of the present disclosure, the locking device is configured as a first ratchet mechanism, and the first ratchet mechanism includes: a first ratchet fitted over the first transmission rod; and a first pawl disposed to the fixing plate via a second rotation shaft, the first pawl being separably fitted with the first ratchet for locking and unlocking the first transmission rod.

According to an embodiment of the present disclosure, the lifting shelf bracket further includes: a second transmission rod having an end rotatably connected to the fixing plate; a ratchet-stopping block fixed to the second transmission rod, and configured to adjust the first pawl to be separably fitted with the first ratchet, and the second transmission rod is configured to drive the ratchet-stopping block to abut against the first pawl so as to separate the first pawl from the first ratchet, when the second transmission rod rotates.

According to an embodiment of the present disclosure, the fixing plate is provided with a first tension spring, the first tension spring is arranged between the first ratchet and the first pawl, the first tension spring has a first end fixed to the fixing plate and a second end fixedly connected with a middle portion of the first pawl, and the first tension spring is configured to pull the first pawl to abut against the first ratchet.

According to an embodiment of the present disclosure, another end of the first transmission rod away from the first gear is provided with a first rotation handle.

According to an embodiment of the present disclosure, the first rotation handle is provided with a second ratchet mechanism, and the second ratchet mechanism includes: a second ratchet fitted over the first transmission rod; a second pawl having an end rotatably connected to the first rotation handle via a third rotation shaft; a second tension spring arranged between the second ratchet and the second pawl, having a first end fixedly connected to the first rotation handle and a second end connected to a middle portion of the second pawl, and configured to drive the second pawl to abut against the second ratchet.

According to an embodiment of the present disclosure, a side of the first rack and a side of the second rack opposite to the side of the first rack both are provided with a guiding groove extending vertically, and two side edges of the fixing plate are movably arranged in the guiding grooves of the first rack and the second rack, respectively.

According to an embodiment of the present disclosure, another end of the second transmission rod away from the ratchet-stopping block is provided with a second rotation handle.

The refrigerator according to one of embodiment of the present disclosure includes: a refrigerator body; and a lifting shelf bracket according to the above embodiment of the present disclosure. The lifting shelf bracket is arranged in the refrigerator body, and the lifting shelf bracket is provided with a shelf thereon.

According to an embodiment of the present disclosure, the refrigerator body is provided with a guiding column arranged vertically therein, and the guiding column passes through and extends out of the shelf.

Embodiments of the present disclosure will be given in part in the following descriptions, become apparent in part from the following descriptions, or be learned from the practice of the present disclosure.

BRIEF DESCRIPTION OF THE DRAWINGS

Embodiments of the present disclosure will become apparent and more readily appreciated from the following descriptions made with reference to the drawings.

Figure 1:
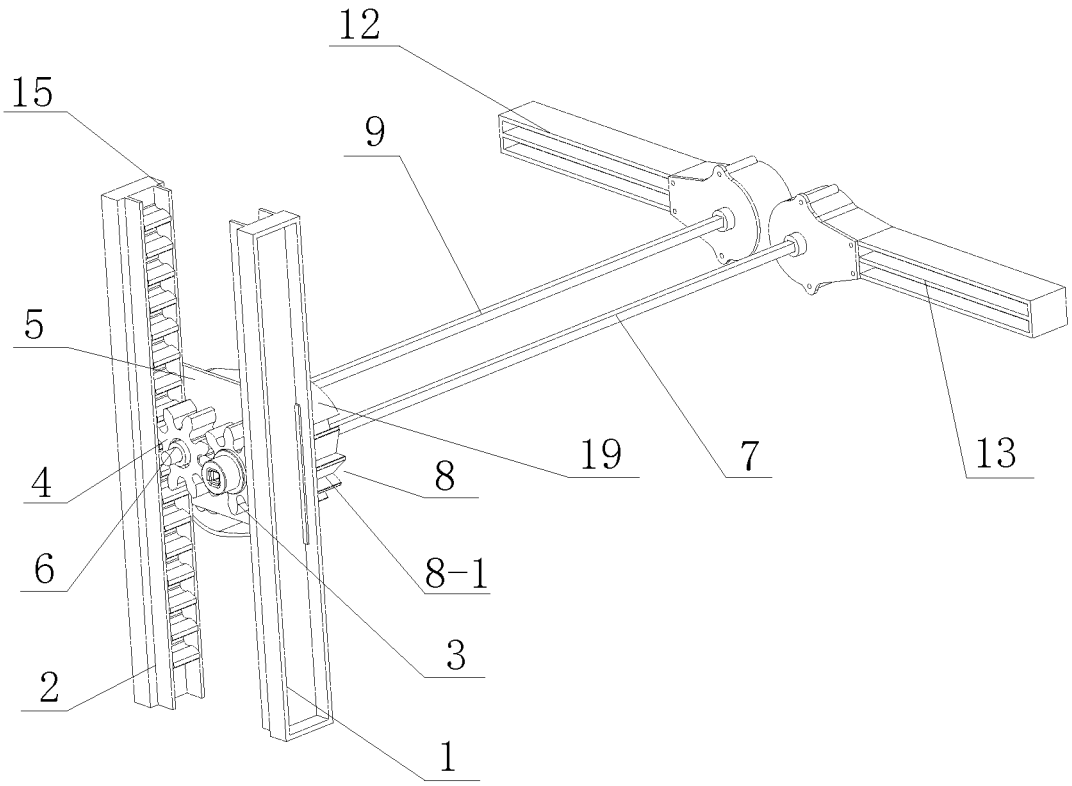
FIG. 1 is a perspective view of a lifting shelf bracket according to an embodiment of the present disclosure.

REFERENCE NUMERALS first rack 1, second rack 2, first gear 3, second gear 4, fixing plate 5, first rotation shaft 6, third rotation shaft 6, first transmission rod 7, first ratchet mechanism 8, first ratchet 8-1, first pawl 8-2, second transmission rod 9, ratchet-stopping block 10, first tension spring 11, second rotation handle 12, first rotation handle 13, second ratchet mechanism 14, second ratchet 14-1, second pawl 14-2, second tension spring 14-3, guiding groove 15, refrigerator body 16, shelf 17, guiding column 18, baffle 19.

DETAILED DESCRIPTION

Reference will be made in detail to embodiments of the present disclosure, and examples of the embodiments are illustrated in the drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, it should be understood that, relative terms such as "central", "up", "down", "front", "rear", "right", "left", "vertical", "horizontal", "top", "bottom", "inner", "outer" as well as derivative thereof should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance. Thus, features limited by "first" and "second" are intended to indicate or imply including one or more than one these features. In the description of the present disclosure, "a plurality of" relates to two or more than two.

A lifting shelf bracket according to one embodiment of the present disclosure will be described with reference to FIGS. 1-9.

As illustrated in FIGS. 1 to 9, the lifting shelf bracket according to one embodiments of the present disclosure includes a first rack 1, a second rack 2, a first gear, a second gear 4, a fixing plate 5, a first transmission rod 7 and a locking device.

As illustrated in FIGS. 1-9, the first rack 1 is arranged vertically, and the second rack 2 is parallel to the first rack 1. In this case, the second rack 2 is also vertically disposed, and a toothed surface of the second rack 2 is opposite to a toothed surface of the first rack 1. In one embodiment, toothed surface may be a surface of the tooth on a gear or used for gear transmission. The first gear 3 and the second gear 4 are disposed between the first rack and the second rack 2, the first gear 3 meshes with the first rack 1, the second gear 4 meshes with the second rack 2, and the first gear 3 and the second gear 4 mesh with each other. The fixing plate 5 is disposed at a same side of the first rack 1 and the second rack 2 in a width direction of the first rack 1 and the second rack 2, and the fixing plate 5 is movable along a length direction of the first rack and the second rack 2. The second gear 4 is rotatably connected to the fixing plate 5 via a first rotation shaft 6. An end of the first transmission rod 7 passes through the fixing plate 5 and is fixedly connected to the first gear 3, and the first transmission rod 7 is rotatable around a central axis of the first transmission rod 7. The locking device is disposed to the fixing plate 5 for locking and unlocking the first transmission rod 7.

That is, the first gear 3 meshes with the first rack 1 and the second gear 4 respectively, and the second gear 4 meshes with the second rack 2; the fixing plate 5 is slidably connected the same side of the first rack 1 and the second rack 2, the second gear 4 is movably connected to the fixing plate 5 via the first rotation shaft 6, the fixing plate 5 is provided with the first transmission rod 7 whose end passes through and extends out of the fixing plate 5, the first transmission rod 7 is axially rotatable, and the end of the first transmission rod 7 is fixedly connected to a center of the first gear 3; the fixing plate 5 is provided with the locking device for locking and unlocking the first transmission rod 7.

In the lifting shelf bracket according to the embodiments of the present disclosure, when the first transmission rod 7 is rotated, the axial rotation of the first transmission rod 7 drives the first gear 3 to rotate, thereby driving the second gear 4 that meshes with the first gear 3 to rotate, so that the first gear 3 and the second gear 4 can be moved up and down along the length direction of the first rack 1 and the second rack 2, then the first transmission rod 7 is locked by the locking device, and hence the height of the raised/lowering shelf bracket is positioned. Thus, the height of the movable shelf bracket can be effectively adjusted as needed, and is also easy to adjust. Further, the gear connection is adopted to provide great stability.

According to an embodiment of the present disclosure, the locking device is a first ratchet mechanism 8, and the first ratchet mechanism 8 includes a first ratchet 8-1 and a first pawl 8-2. The first ratchet 8-1 is fitted over the first transmission rod 7, the first pawl 8-2 is disposed to the fixing plate 5 via a second rotation shaft 6, and the first pawl 8-2 is separably fitted with the first ratchet 8-1 to lock and unlock the first transmission rod 7. For example, as illustrated in FIG. 2, FIG. 3, FIG. 4 and FIG. 5, the locking device is the first ratchet mechanism 8, and the first ratchet mechanism 8 includes the first ratchet 8-1 and the first pawl 8-2 for locking the rotation of the first ratchet 8-1. The first ratchet 8-1 is fitted over the first transmission rod 7, the axial rotation of the first transmission rod 7 drives the first ratchet 8-1 to rotate along its central axis, and the first pawl 8-2 is disposed to the fixing plate 5 via the second rotation shaft 6. Thus, the locking device adopts the first ratchet mechanism 8 such that the first transmission rod 7 is capable of unidirectional rotation. For example, as illustrated in FIG. 3, the first pawl 8-2 can lock the first transmission rod 7 when fitted with the first ratchet 8-1, such that the first transmission rod 7 may not be rotated clockwise, and when the first pawl 8-2 is separated from first ratchet 8-1, the first ratchet 8-1 is released and the first transmission rod 7 can be rotated clockwise. In the present disclosure, the first transmission rod 7 can be rotated in a reverse direction, so that the first gear 3 and the second gear 4 can move upwards; when the first gear 3 and the second gear 4 need to move downwards, the first pawl 8-2 is adjusted such that the first pawl 8-2 is disengaged from the first ratchet 8-1, and thus, under the action of gravity, the first gear 3 and the second gear 4 will drive the first transmission rod 7 to move downwards. When the required position is reached, the first pawl 8-2 is adjusted to lock the first ratchet 8-1, so as to achieve positioning.

According to a further embodiment of the present disclosure, the lifting shelf bracket further includes a second transmission rod 9 and a ratchet-stopping block 10. An end of the second transmission rod 9 is rotatably connected to the fixing plate 5, and the ratchet-stopping block 10 is fixed to the second transmission rod 9. The ratchet-stopping block 10 is used to adjust the first pawl 8-2 to be separably fitted with the first ratchet 8-1. The second transmission rod 9 is configured to drive the ratchet-stopping block 10 to abut against the first pawl so as to separate the first pawl 8-2 from the first ratchet 8-1, when the second transmission rod 9 is rotated. For example, as illustrated in FIG. 5, FIG. 7, FIG. 8 and FIG. 9, the lifting shelf bracket also includes the second transmission rod 9 and the ratchet-stopping block 10 for adjusting the first pawl 8-2 to approach or move away from the first ratchet 8-1, and the end of the second transmission rod 9 is movably connected to the fixing plate 5. The ratchet-stopping block 10 is fixed to the second transmission rod 9, and thus the axial rotation of the second transmission rod 9 may drive the ratchet-stopping block 10 to abut against the first pawl 8-2, such that the first pawl 8-2 will move away from the first ratchet 8-1. Thus, when the first paw 8-2 needs to be disengaged from the first ratchet 8-1, the second transmission rod 9 is rotated to drive the ratchet-stopping block 10 to abut against the first pawl 8-2, such that the first pawl 8-2 is separated from the first ratchet 8-1, thus providing convenient operations.

Figure 3:
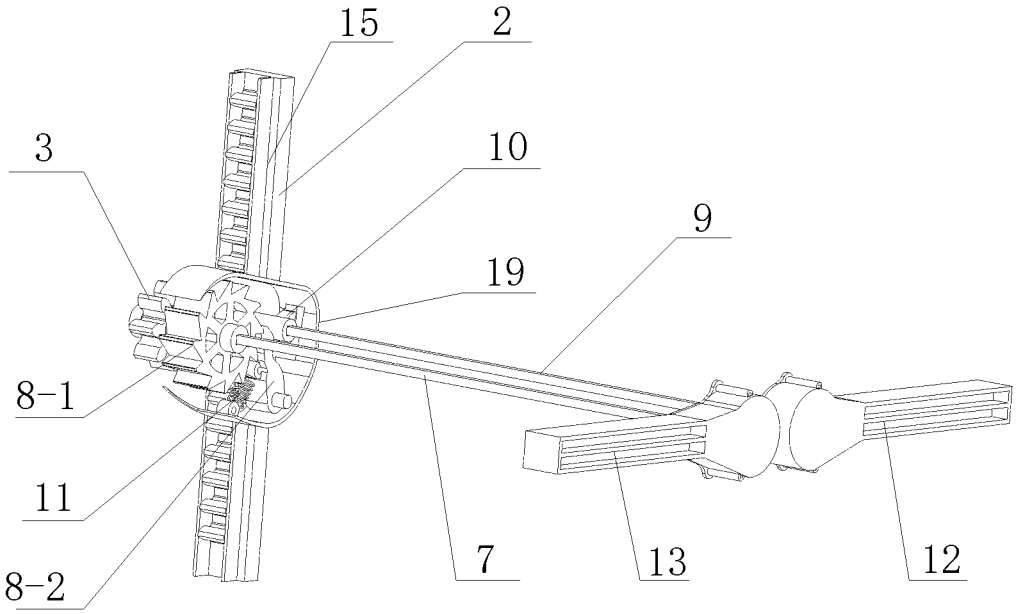
FIG. 3 is still another perspective view of a lifting shelf bracket according to an embodiment of the present disclosure, in which a first rack and a fixing plate are not illustrated.
Figure 4:
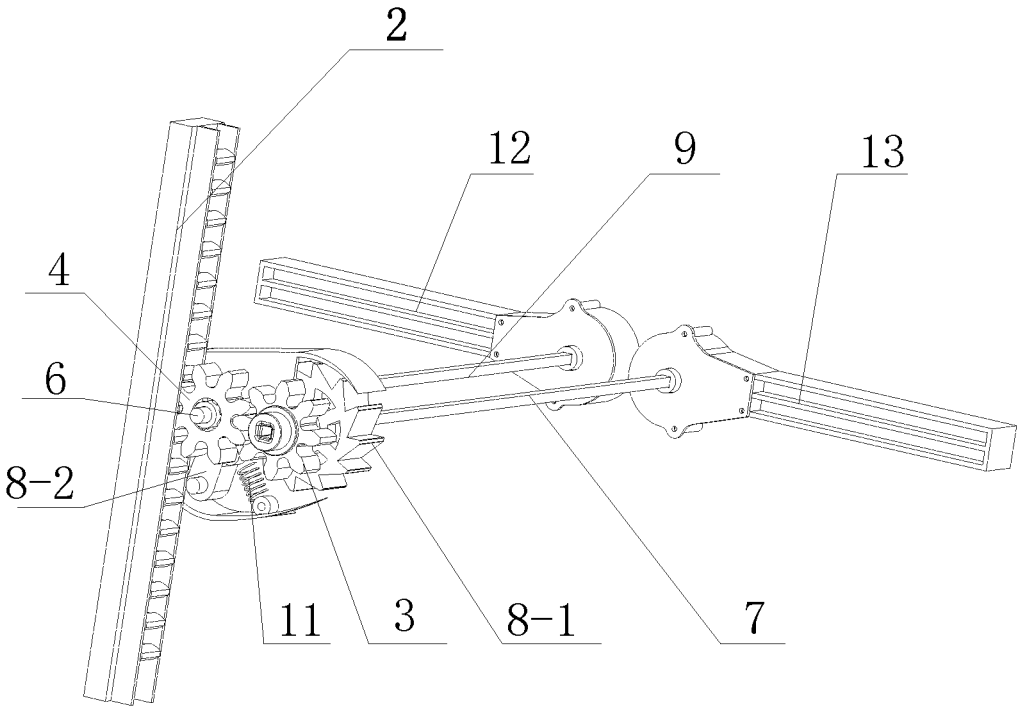
FIG. 4 is a further perspective view of a lifting shelf bracket according to an embodiment of the present disclosure, in which a first rack A and a fixing plate are not illustrated.
Figure 5:
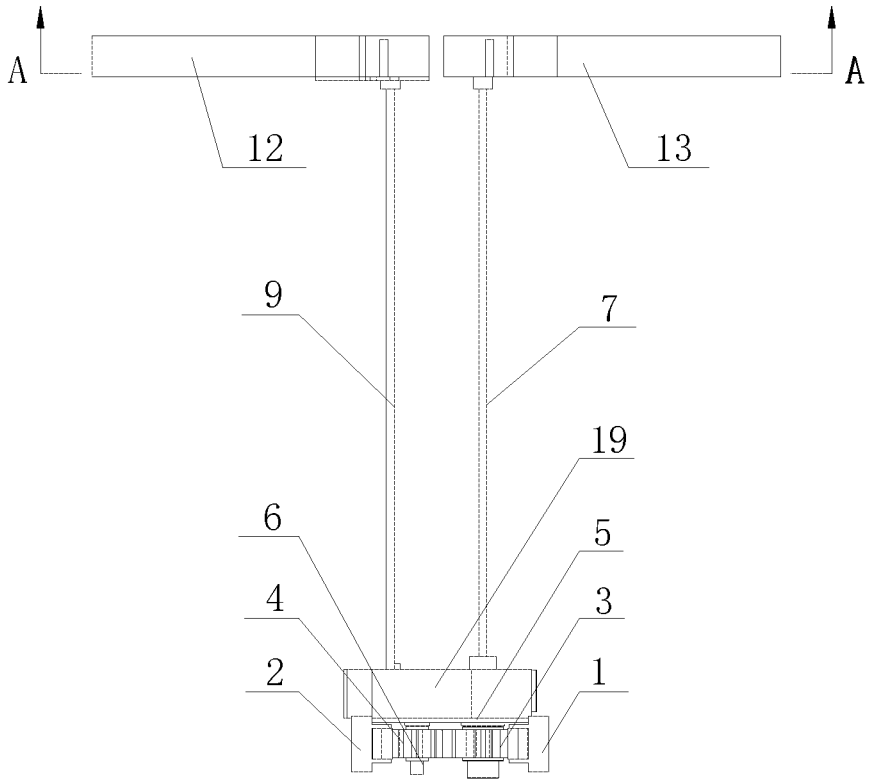
FIG. 5 is a top view of a raised/lowering shelf bracket according to an embodiment of the present disclosure.
Figure 8:
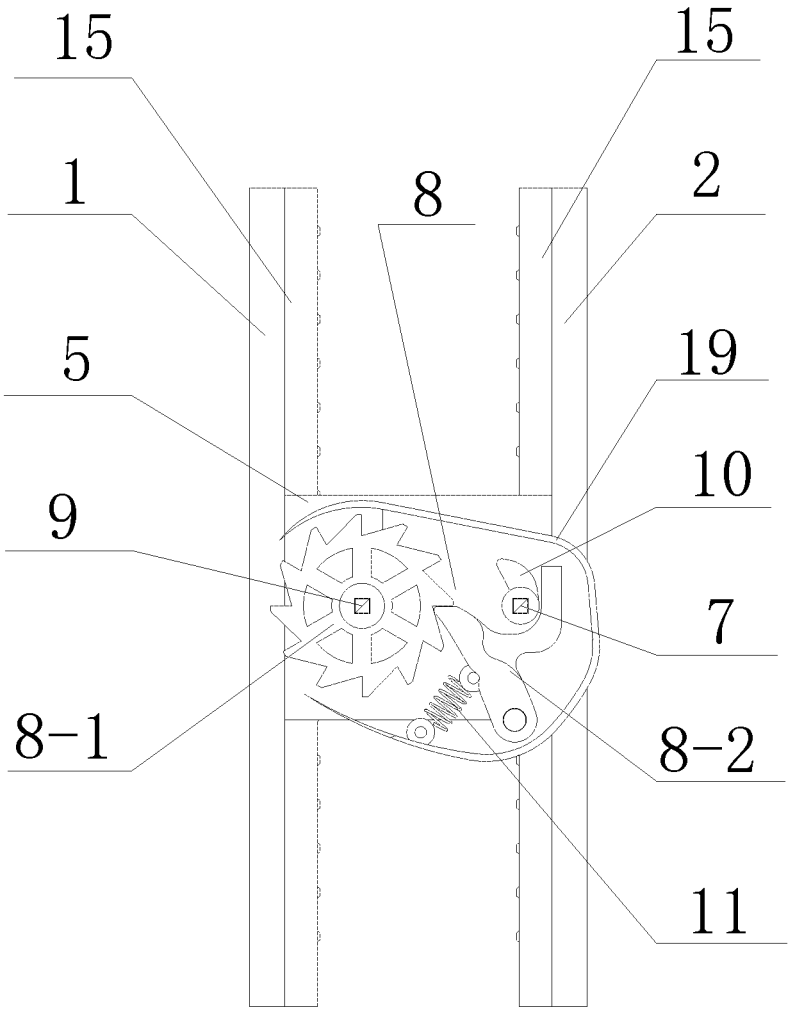
FIG. 8 is a schematic view illustrating an installation of a first ratchet mechanism in a lifting shelf bracket according to an embodiment of the present disclosure, in which a first pawl locks a first ratchet.

Further, as illustrated in FIG. 3, FIG. 4 and FIG. 8, the fixing plate 5 is provided with a first tension spring 11, and the first tension spring 11 is arranged between the first ratchet 8-1 and the first pawl 8-2. A first end of the first tension spring 11 is fixed to the fixing plate 5, and a second end of the first tension spring 11 is fixedly connected to a middle portion of the first pawl 8-2. The first tension spring 11 is used to pull the first pawl 8-2 to abut against the first ratchet 8-1. Thus, the first tension spring 11 is provided such that it is easy for the first pawl 8-2 to reset to lock the first ratchet 8-1. After the first pawl 8-2 is disengaged from the first ratchet 8-1 and hence the first gear 3 and the second gear 4 are lowered to the desired position, the second transmission rod 9 is unlocked, and the first pawl 8-2 is reset to re-lock the first ratchet 8-1 under the action of the first tension spring 11, so as to achieve positioning.

As illustrated in FIGS. 1 to 4, another end of the first transmission rod 7 away from the first gear 3 may be provided with a first rotation handle 13. Thus, it is convenient to rotate the first transmission rod 7 via providing the first rotation handle 13.

Figure 6:
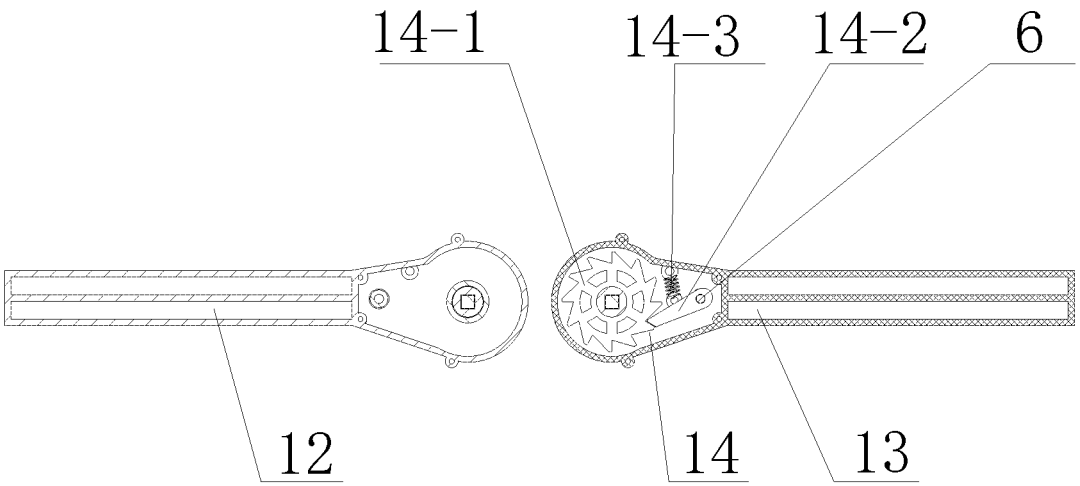
FIG. 6 is a sectional view taken along line A-A in FIG. 5.
Figure 7:
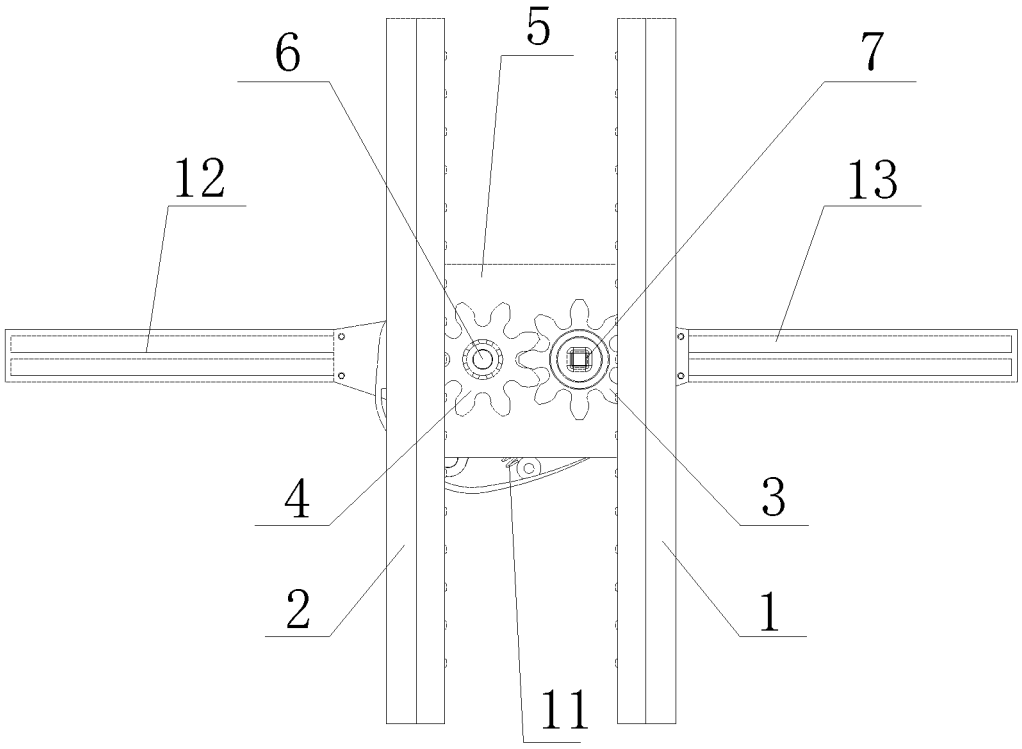
FIG. 7 is a rear view of a lifting shelf bracket according to an embodiment of the present disclosure.

According to a further embodiment of the present disclosure, as illustrated in FIG. 6, the first rotation handle 13 is provided with a second ratchet mechanism 14, and the second ratchet mechanism 14 includes a second ratchet 14-1, a second pawl 14-2 and a second tension spring 14-3. The second ratchet 14-1 is fitted over the first transmission rod 7, and the axial rotation of the first transmission rod 7 may drive the second ratchet 14-1 to rotate axially. An end of the second pawl 14-2 is rotatably connected to the first rotation handle 13 via a third rotation shaft 6, that is, the end of the second pawl 14-2 is movably connected to the first rotation handle 13 via the third rotation shaft 6. The second tension spring 14-3 is arranged between the second ratchet 14-1 and the second pawl 14-2. A first end of the second tension spring 14-3 is fixedly connected to the first rotation handle 13, and a second end of the second tension spring 14-3 is connected to a middle portion of the second pawl 14-2. The second tension spring 14-3 is configured to drive the second pawl 14-2 to abut against the second ratchet 14-1. Thus, the second ratchet mechanism 14 is provided in the first rotation handle 13, such that the first rotation handle 13 can be reset after rotation.

As illustrated in FIGS. 1-4, another end of the second transmission rod 9 away from the ratchet-stopping block 10 may be provided with a second rotation handle 12. Thus, it is convenient to rotate the second transmission rod 9 via providing the second rotation handle 12.

Figure 2:
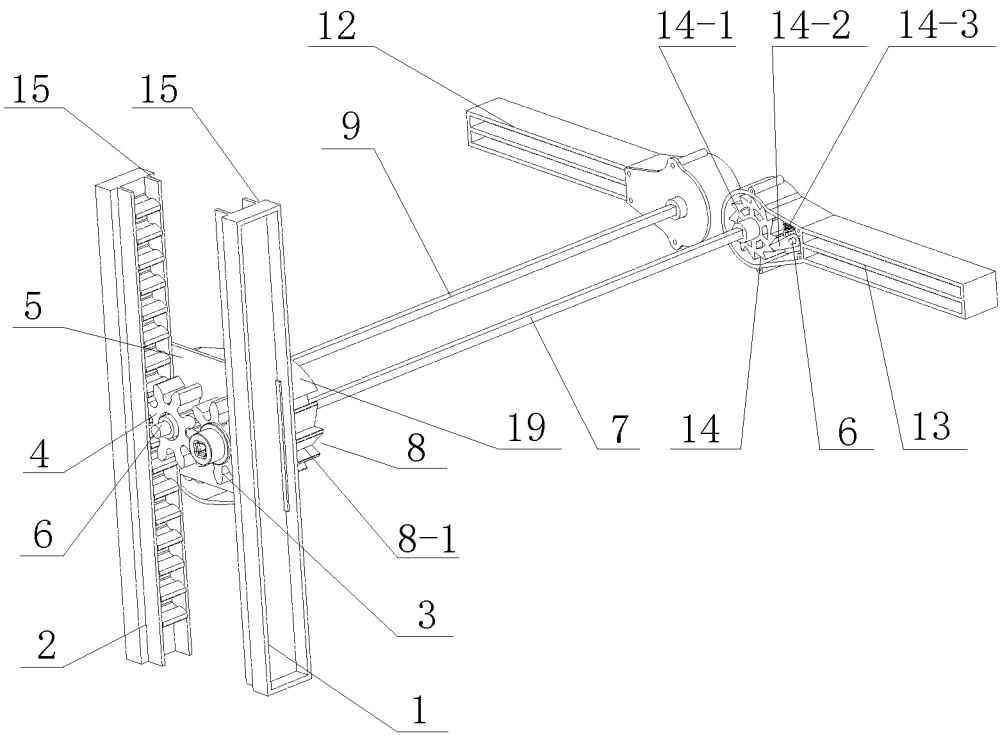
FIG. 2 is another perspective view of a lifting shelf bracket according to an embodiment of the present disclosure, in which an internal structure of a first rotation handle is illustrated.

In one embodiment, as illustrated in FIG. 1 to FIG. 3, a side of the first rack 1 and a side of the second rack 2 opposite to the side of the first rack 1 both are provided with a guiding groove 15 extending vertically, and two side edges of the fixing plate 5 are movably arranged in the guiding grooves 15 of the first rack 1 and the second rack 2, respectively. That is, the opposite sides of the first rack 1 and the second rack 2 both are provided with the guiding groove 15 arranged vertically, and the two side edges of the fixing plate 5 are slidably disposed in the guiding grooves 15. Thus, the guiding groove 15 is provided to guide the movement of the fixing plate 5 so as to improve the stability of the fixing plate 5. A baffle 19 is provided to protect the first ratchet mechanism 8 and further to prevent water from entering or dropping onto the first ratchet mechanism 8.

Further, as illustrated in FIGS. 1 and 3, the fixing plate 5 is provided with a baffle 19 at its periphery for protecting the first ratchet mechanism 8. Thus, the baffle 19 is provided to protect the first ratchet mechanism 8 and further to prevent water from entering or dropping onto the first ratchet mechanism 8.

Figure 9:
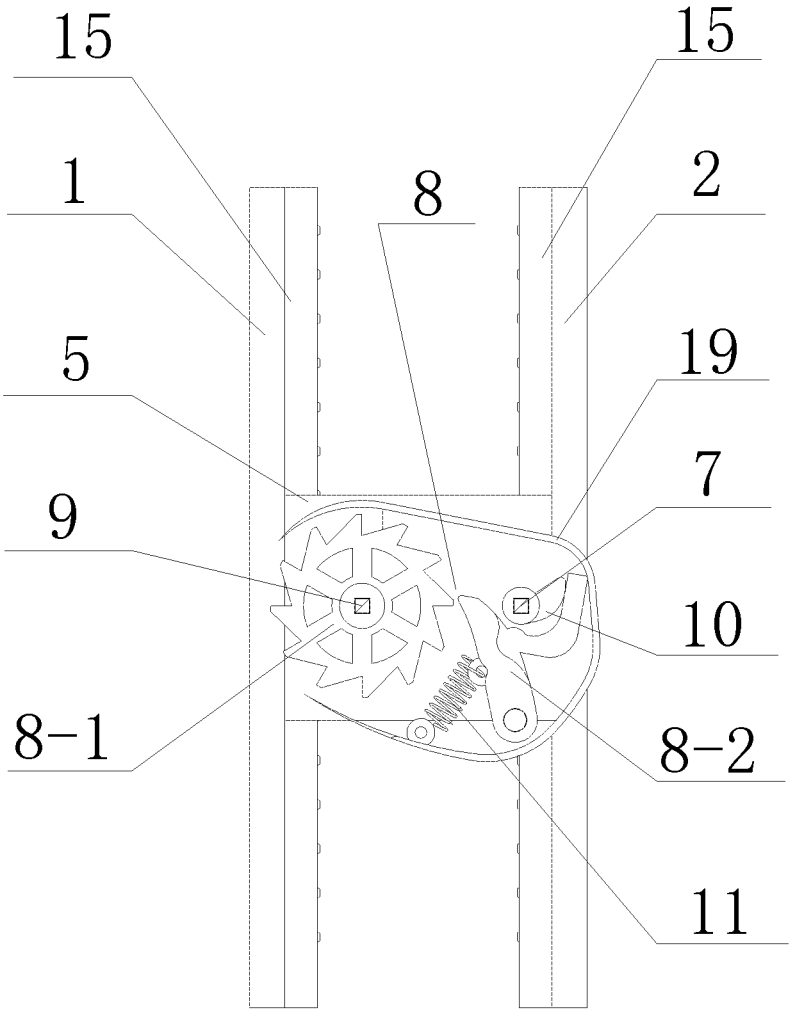
FIG. 9 is another schematic view illustrating an installation of a first ratchet mechanism in a lifting shelf bracket according to an embodiment of the present disclosure, in which a first pawl is separated from a first ratchet.

A working principle of the lifting shelf bracket according to the embodiments of the present disclosure is described as follows: the first rotation handle 13 is rotated counterclockwise, then the first rotation handle 13 drives the first ratchet 8-1 and the first gear 3 to rotate counterclockwise, and the first gear 3 drives the second gear 4 to rotate clockwise, such that the first gear 3 and the second gear 4 roll up along the first rack 1 and the second rack 2, so as to drive the fixing plate 5 as well as the first transmission rod 7 and the second transmission rod 9 to move upwards, thereby realizing the rise of the lifting shelf bracket. Due to the unidirectional rotation of the first ratchet mechanism 8, the first pawl 8-2 locks the first ratchet 8-1 when the lifting shelf bracket rises to a designated position, as illustrated in FIG. 8, and the locked first ratchet 8-1 may not rotate clockwise, so that the first gear 3 may not rotate, and hence the lifting shelf bracket will not drop. As illustrated in FIG. 6, the second ratchet mechanism 14 is configured in such a manner that the second ratchet 14-1 will not drive the first transmission rod 7 to rotate when the second ratchet 14-1 is rotated clockwise in FIG. 6. Therefore, after the first rotation handle 13 drives the first transmission rod 7 to rotate counterclockwise, the first rotation handle 13 can be reset, and during the resetting process of the first rotation handle 13, the first transmission rod 7 does not rotate. When the lifting shelf bracket needs to be lowered, the second rotation handle 12 is rotated clockwise to drive the clockwise rotation of the second transmission rod 9, so as to drive the ratchet-stopping block 10 to abut against the first pawl 8-2, such that the first pawl 8-2 is disengaged from the first ratchet 8-1, as illustrated in FIG. 9. In this case, the locking of the first pawl 8-2 on the first ratchet 8-1 fails. Under the action of gravity, the first gear 3 rotates clockwise, and the second gear 4 rotates counterclockwise, thus driving the first transmission rod 7 and the second transmission rod 9 to move downwards. When the first transmission rod 7 and the second transmission rod 9 move to the desired position, the second rotation handle 12 is released, and the first pawl 8-2 is reset to abut against the first ratchet 8-1 under the action of the first tension spring 11, so as to achieve the re-locking of the first ratchet 8-1, thus playing the role of automatic emergency brake.

Figure 10:
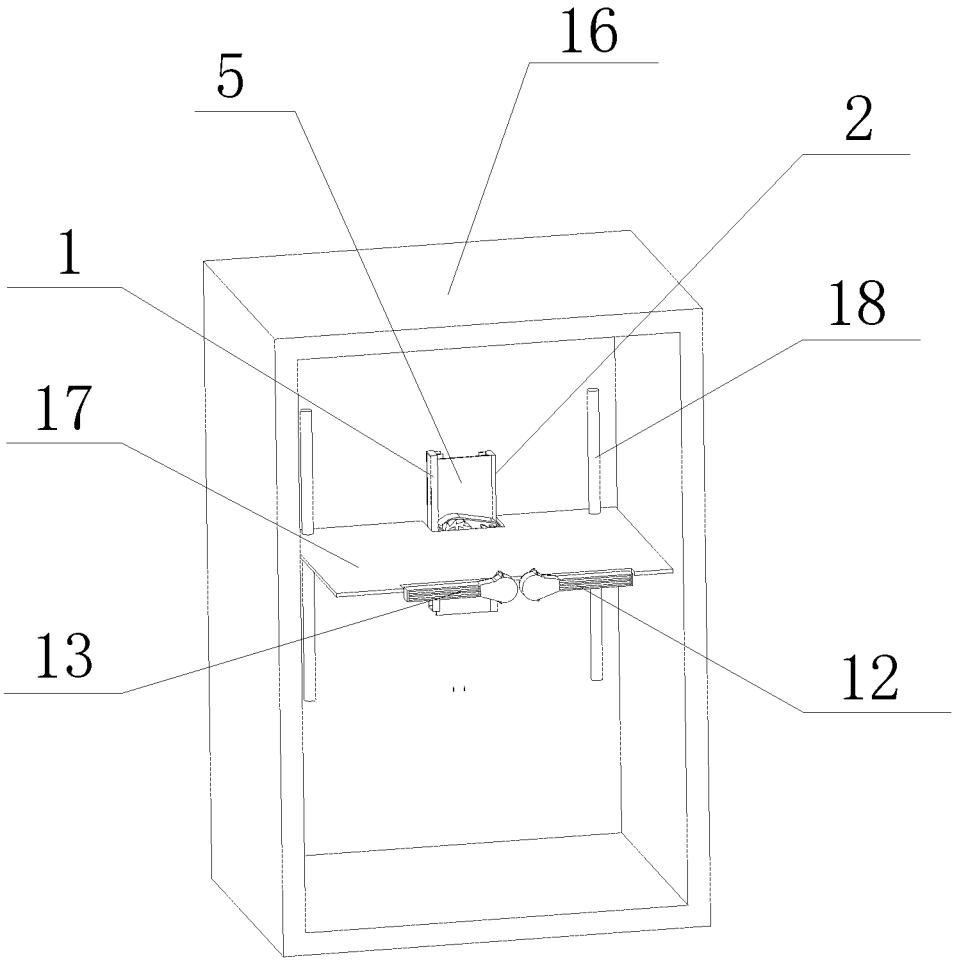
FIG. 10 is a schematic view of a refrigerator according to an embodiment of the present disclosure.
Figure 11:
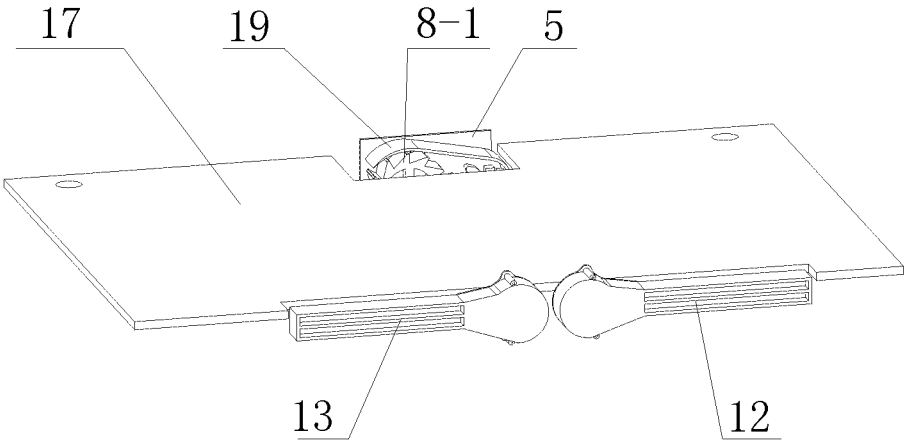
FIG. 11 is a schematic view illustrating a shelf being mounted on a lifting shelf bracket of a refrigerator according to an embodiment of the present disclosure.
Figure 12:
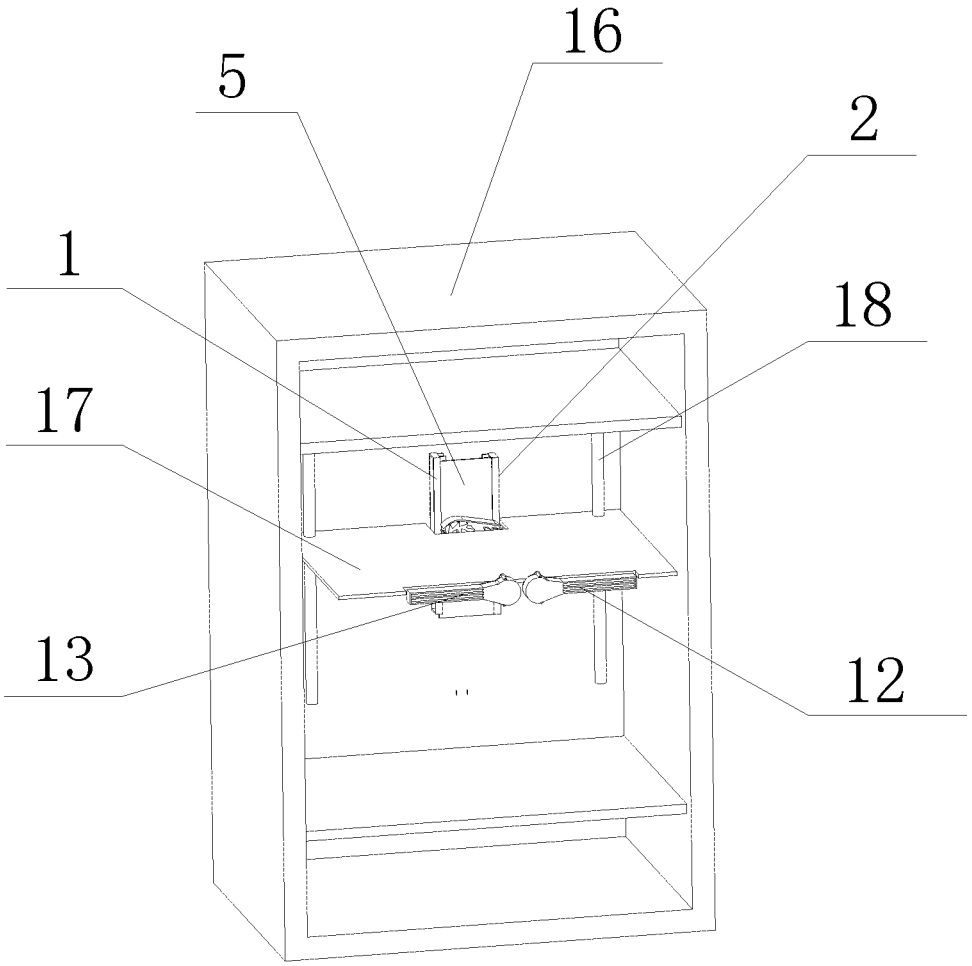
FIG. 12 is a schematic view of a refrigerator according to another embodiment of the present disclosure.

As illustrated in FIGS. 10-12, a refrigerator according to embodiments of the present disclosure includes a refrigerant body 16 and a lifting shelf bracket according to embodiments of the present disclosure. The lifting shelf bracket is arranged in the refrigerator body 16, and the lifting shelf bracket is provided with a shelf 17 thereon.

When the lifting shelf bracket is adjusted, the first transmission rod 7 may be rotated first, and the axial rotation of the first transmission rod 7 drives the first gear 3 to rotate, so as to further drive the second gear 4 that meshes with the first gear 3 to rotate, so that the first gear 3 and the second gear 4 move up and down along the length direction of the first rack 1 and the second rack 2, and then the first transmission rod 7 is locked by the locking device to position the height. Thus, the height of the movable shelf bracket can be effectively adjusted as needed, and is also easy to adjust. Further, the gear connection is adopted to provide great stability. When the second rotation handle 12 on the right side is released, the first ratchet 8-1 is reset for brake due to an elastic force of the stretched first tension spring 11 itself, so as to cause a brake on the lifting shelf bracket, thus preventing an accident downward sliding of the lifting shelf bracket. The raised/lowering shelf bracket is provided in the refrigerant body 16, and the height and position of the raised/lowering shelf bracket can be adjusted at will, such that it is convenient to place food on the uppermost raised/lowering shelf bracket and to take food off the uppermost raised/lowering shelf bracket, for the refrigerator having a large (high and deep) volume.

In the refrigerator according to the embodiments of the present disclosure, since the lifting shelf bracket is disposed in the refrigerator body 16, and the height and position of the lifting shelf bracket can be adjusted at will, it is convenient to place food on the uppermost raised/lowering shelf bracket and to take food off the uppermost raised/lowering shelf bracket, for the refrigerator having the large (high and deep) volume.

Further, as illustrated in FIG. 10 and FIG. 12, the refrigerator body 16 is provided with a guiding column 18 arranged vertically therein, and the guiding column 18 passes through and extends out of the shelf 17. Thus, the guiding column 18 can guide the movement of the shelf 17, so as to ensure the stability of the movement of the shelf 17. Further, as illustrated in FIG. 11, the first transmission rod 7 and the second transmission rod 9 are located on the same level, the shelf 17 is placed on the first transmission rod 7 and the second transmission rod 9, and the shelf 17 is provided with a hole through which the guiding column 18 passes.

As illustrated in FIG. 12, in an embodiment of the present disclosure, the lifting shelf bracket according to the present disclosure may be disposed in the middle of an interior of the refrigerator body 16, a fixed shelf 17 may be disposed above the raised/lowering shelf bracket, and another fixed shelf 17 may be disposed below the raised/lowering shelf bracket. By adjusting the lifting shelf bracket to move up and down, it is possible to adjust the storage space of the lifting shelf bracket and the storage space of the shelf 17 below the lifting shelf bracket as needed.

The above descriptions are some of the embodiments of the present disclosure, and not intended to limit the present disclosure. Any modifications, equivalents, improvements, etc. within the spirit and principle of the present disclosure should be contained in the protection scope of the present disclosure.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A lifting shelf bracket, comprising:

a first rack arranged vertically and having a toothed surface;

a second rack arranged parallel to the first rack, and having a toothed surface opposite to the toothed surface of the first rack;

a first gear and a second gear meshing with each other, the first gear and the second gear being disposed between the first rack and the second rack, the first gear meshing with the first rack, and the second gear meshing with the second rack;

a fixing plate disposed at a same side of the first rack and the second rack in a width direction of the first rack and the second rack, the fixing plate being movable in a length direction of the first rack and the second rack, and the second gear being rotatably connected to the fixing plate via a first rotation shaft;

a first transmission rod having a central axis and an end passing through the fixing plate and fixedly connected to the first gear, and the first transmission rod being rotatable around the central axis; and a locking device provided on the fixing plate for locking and unlocking the first transmission rod.

2. The lifting shelf bracket according to claim 1, wherein the locking device is configured as a first ratchet mechanism and the first ratchet mechanism comprises:

a first ratchet fitted over the first transmission rod; and a first pawl provided on the fixing plate via a second rotation shaft, the first pawl being separably fitted with the first ratchet for locking and unlocking the first transmission rod.

3. The lifting shelf bracket according to claim 2, further comprising:

a second transmission rod having an end rotatably connected to the fixing plate; and a ratchet-stopping block fixed to the second transmission rod, and configured to adjust the first pawl to be separably fitted with the first ratchet, wherein the second transmission rod is configured to drive the ratchet-stopping block to abut against the first pawl so as to separate the first pawl from the first ratchet, when the second transmission rod rotates.

4. The lifting shelf bracket according to claim 3, wherein another end of the second transmission rod away from the ratchet-stopping block is provided with a second rotation handle.

5. The lifting shelf bracket according to claim 3, wherein the fixing plate is provided with a first tension spring, the first tension spring is arranged between the first ratchet and the first pawl, the first tension spring has a first end fixed to the fixing plate and a second end fixedly connected to a middle portion of the first pawl, and the first tension spring is configured to pull the first pawl to abut against the first ratchet.

6. The lifting shelf bracket according to claim 1, wherein another end of the first transmission rod away from the first gear is provided with a first rotation handle.

7. The lifting shelf bracket according to claim 6, wherein the first rotation handle is provided with a second ratchet mechanism, and the second ratchet mechanism comprises:

a second ratchet fitted over the first transmission rod;

a second pawl having an end rotatably connected to the first rotation handle via a third rotation shaft; and a second tension spring arranged between the second ratchet and the second pawl, having a first end fixedly connected to the first rotation handle and a second end connected to a middle portion of the second pawl, and configured to drive the second pawl to abut against the second ratchet.

8. The lifting shelf bracket according to claim 1, wherein a side of the first rack and a side of the second rack opposite to the side of the first rack both are provided with a guiding groove extending vertically, and two side edges of the fixing plate are movably arranged in the guiding grooves of the first rack and the second rack, respectively.

9. The lifting shelf bracket according to claim 1, wherein the toothed surface is configured as a gear used for gear transmission.

10. A refrigerator, comprising:

a refrigerator body; and a lifting shelf bracket, comprising:

a first rack arranged vertically and having a toothed surface;

a second rack arranged parallel to the first rack, and having a toothed surface opposite to the toothed surface of the first rack;

a first gear and a second gear meshing with each other, the first gear and the second gear being disposed between the first rack and the second rack, the first gear meshing with the first rack, and the second gear meshing with the second rack;

a fixing plate disposed at a same side of the first rack and the second rack in a width direction of the first rack and the second rack, the fixing plate being movable in a length direction of the first rack and the second rack, and the second gear being rotatably connected to the fixing plate via a first rotation shaft;

a first transmission rod having a central axis and an end passing through the fixing plate and fixedly connected to the first gear, and the first transmission rod being rotatable around the central axis; and a locking device provided on the fixing plate for locking and unlocking the first transmission rod, the lifting shelf bracket being arranged in the refrigerator body, and the lifting shelf bracket being provided with a shelf thereon.

11. The refrigerator according to claim 10, wherein the refrigerator body is provided with a guiding column arranged vertically therein, and the guiding column passes through and extends out of the shelf.

12. The refrigerator according to claim 10, wherein the toothed surface is configured as a gear used for gear transmission.

* * * * *